United States Patent [19]

Fleissner

[11] Patent Number: 4,645,109

[45] Date of Patent: Feb. 24, 1987

[54] APPARATUS FOR THE CONTINUOUS TREATMENT OF ENDLESS TEXTILE MATERIAL

[75] Inventor: Gerold Fleissner, Chur, Switzerland

[73] Assignee: Vepa AG, Basel, Switzerland

[21] Appl. No.: 737,482

[22] Filed: May 24, 1985

[30] Foreign Application Priority Data

May 25, 1984 [DE] Fed. Rep. of Germany ..... 3419487

[51] Int. Cl.[4] ..... B65H 23/20

[52] U.S. Cl. ..... 226/42; 68/13 R; 68/22 R; 226/45; 226/119

[58] Field of Search ..... 68/13 R, 22 R; 226/24, 226/42, 44, 45, 108, 111, 119; 242/75.51; 318/6, 7

[56] References Cited

U.S. PATENT DOCUMENTS 2,797,918 7/1957 McArthur et al. ..... 226/42
3,643,844 2/1972 Hunter ..... 226/111
3,659,767 5/1972 Martin ..... 226/44 X
3,858,820 1/1975 Crouse ..... 242/75.51 X
3,998,368 12/1976 Hackney ..... 226/42

FOREIGN PATENT DOCUMENTS 641015 1/1979 U.S.S.R. ..... 68/13 R

*Primary Examiner*—Philip R. Coe
*Attorney, Agent, or Firm*—Antonelli, Terry & Wands

[57] ABSTRACT

A treatment apparatus for a textile material e.g. a wet tow, has a machine with guide rolls arranged in two rows for the meander-like guidance of the endless textile material. In order to obtain uniform material tension at each of the, for example, top guide rolls, these are not only electrically driven individually but also are subjected to a specific torque, determined by measuring the actual longitudinal tension in the length of material at, for example, the first and last guide rolls, by electronic comparison of the measured data, and by utilization of the positive or negative measuring result for controlling the torque of the incorrectly turning guide roll.

6 Claims, 4 Drawing Figures

APPARATUS FOR THE CONTINUOUS TREATMENT OF ENDLESS TEXTILE MATERIAL

This invention relates to an apparatus for the continuous treatment of endless textile material, such as, for example, lengths of fabric, with several guide rolls rotatably mounted in a housing, the guide rolls being arranged in two rows in series and electrically driven, in part, individually and with a pair of pressure rolls for conveying the textile material. The pair of pressure rolls is arranged before and/or after the guide rolls and is controlled in its rotational speed by a tension control device, such as a dancer roll, biased by a pressure cylinder with a predetermined pressure.

When processing endless textile material, be it a broad material or be it, for example, tow, tension of the material increases from one guide roll to the next on account of frictional resistance on these guide rolls. This tension effects a retarded torque that would cause deceleration of the material traveling at a certain speed, if a constant speed were not maintained by the tension applied by a pair of pressure rolls. Consequently, the tensile stress in the textile material rises, namely from one guide roll to the next guide roll.

If, furthermore, a shrinking length of material is introduced into a wet treatment apparatus of the aforementioned type, the textile material during the course of treatment will contract to an increasing extent, namely with a shrinkage curve characteristic for the textile material. As a consequence thereof, each guide roll following in the conveying direction must revolve at a different rotational speed than the preceding roll. This is so, because a requirement in such a treatment is to produce, over the entire working operation at least a uniform material tension, in the textile material. Otherwise the shrinking process would be deleteriously affected.

Furthermore, one must keep in mind that when performing a wet treatment, with a given traveling speed of the textile material, the material is burdened by entrained water. As a result, material tension increases even more at each guide roll. The stress exerted by the entrained water rises in parabolic form with increasing speed of the material.

In order to solve this problem, it is known (DOS No. 1,474,969) to operate the individual guide rolls which are driven, for example, electrically, by way of manually adjustable friction clutches, or to utilize a friction drive mechanism. However, an unsatisfactory result is obtained with the aid of these contact devices. On the one hand, these friction drive mechanisms can be adjusted only inaccurately. Their adjustability is very low. Moreover, a much more essential drawback is the necessity that the drive mechanisms must be separately adjusted in each case to the conditions of each drive roll and/or to the special type of treatment for the material. This can only be performed by an expert operator, and even such operator will not achieve adequate adjustment since error sources cannot be avoided.

It is furthermore known to drive the individual guide rolls by means of a motor with constant torque, such as an oil motor. However, in this solution, the expense for the drive means is very high.

Finally, it has been known from DOS No. 2,551,048 to connect the pressure cylinder of the tension control device, such as a dancer roll, with a valve responsive to initial pressure: this valve transmits, via regulating members, the determined pressure values for the direct driving of the guide rolls. This solution simplifies the desired drive for the guide rolls in dependence on the desired speed of the material or on the textile material to be treated in a particular case. However, there is still the unsolved problem of how to control the drive means for the individual guide rolls in dependence on the material tension specifically prevailing at that location.

The invention is based on the object of further developing an apparatus of the type heretofore described so that the guide rolls, provided within the apparatus with a direct drive mechanism, are driven in a differentiated fashion, namely in comparison with the respectively prevailing material tension with the objective to provide at each guide roll exactly the same torque in dependence on the shrinkage result attained at that point, on the respectively varying friction values, or on the taken-up entrained water, etc.

In order to solve the posed problem, the invention provides that the electrical drive means of at least one of the guide rolls is electrically connected to a load cell; the combined measured values of the cell are compared in a differential amplifier and converted therein into a positive or negative control signal, and the control signal is transmitted by the amplifier to correct the actual torque of the respective guide roll drive means. In this way, an exact comparison is possible of the actually prevailing torques at the series-connected, driven guide rolls—in most cases those of the top row—and the comparison value can be utilized immediately for correcting the necessary drive means.

In general, it is sufficient for the first and last driven guide rolls of this treatment apparatus to be equipped with the load cells. A solution is likewise possible, of course, wherein the weight of the dancer roll, which predetermines the tension in the textile material by its active weight, is measured and employed for adjusting the torque of the guide roll drive means within the treatment apparatus, or wherein more than merely two, perhaps all of the driven guide rolls are compared with one another with respect to their drive characteristic and are controlled.

The desired torque for driving the guide rolls is suitably determined by the active weight of the dancer rolls or the like.

One embodiment of the apparatus of this invention is illustrated in the drawing wherein.

Figure 1:
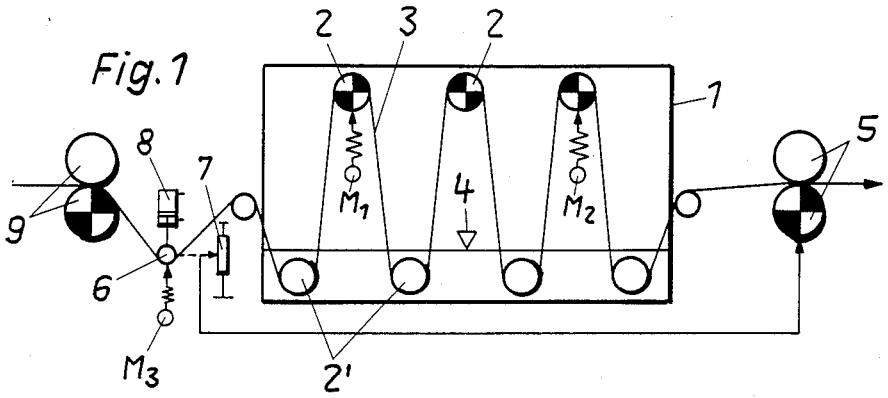
FIG. 1 shows a sectional view along a roll vat with a pair of pressure rolls arranged upstream and downstream thereof.

The invention will be described in detail, using a wet treatment as an example. The apparatus consists of a housing 1, closed all around, with an inlet and outlet provided at the end faces, wherein two rows of guide rolls 2, 2' for the meander-like conveyance of a textile material 3 are rotatably mounted. The guide rolls 2' of the bottom row revolve within a liquid having a level 4. Rolls 2' are not driven; whereas the rolls 2 of the top row are each electrically driven individually. A pair of pressure rolls 5 is arranged at the end of the treatment installation, exerting a certain longitudinal tension on the textile material 3 for the uniform transport thereof.

The conveying speed, the speed of rotation of the pressure rolls 5, is determined by the dancer roll 6 arranged in front of the installation, which dancer roll acts on the pressure roll drive means by way of potentiometer 7. The dancer roll 6 is stressed pneumatically or hydraulically by a pressure cylinder 8. However, it is also possible to provide here an electric tension control means. In correspondence with the longitudinal tension acting on the material at this location, the desired torque is determined at the roll drive mechanisms 10 or the rolls 2. Another pair of pressure rolls 9 is disposed in front of this dancer roll; actually, this pair of pressure rolls is to be associated with the preceding parts of the machine, not shown, but they control between them, by means of their respective electrical drive mechanism, the transporting velocity of the textile material 3.

Figure 2:
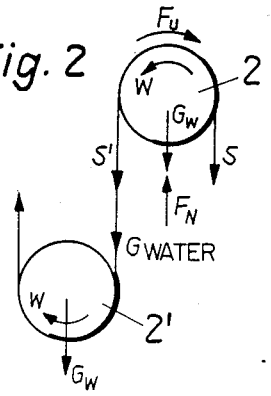
FIG. 2 shows a guide roll of the top and bottom rows with the forces prevailing at those locations.

Several forces act on the guide rolls 2, 2' arranged in the top and bottom rows: these forces are indicated in detail in FIG. 2. First of all, the tensile force S on the length of material is to be noted, which is determined by the transporting of the textile material through the treatment installation by means of the pressure rolls 5, 9. With respect to the roll 2, the force S' on the other side of the roll corresponds to the tensile force S exerted on the length of material. At the roll 2, revolving in a driven fashion with the peripheral force $F_u$, the frictional resistance W is effective against the peripheral force, and the roll weight $G_w$ acts perpendicularly downwardly.

Furthermore, a force $G_{Water}$ is effected on the length of material traveling upwards from roll 2' to roll 2; this force is determined by the entrained water. The quantity of water entrained by the textile material is dependent on the conveying speed of the textile material. Besides the tensile forces S and S' on the length of material, there are effective on the lower, not driven guide roll 2' also the resistive force based on friction in gaskets and bearings, oriented counter to the conveying direction, and the weight of the roll. A uniform longitudinal tension within the length of material between a point upstream of the top guide roll 2 and downstream of the guide roll, i.e. the material tensile forces S and S', exists only if these two oppositely directed forces are equally large. In order to achieve this, the drive mechanism 10 of the guide roll 2 must revolve at a torque to be determined.

Figure 3:
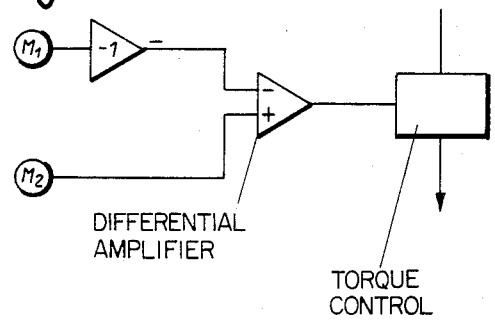
FIG. 3 shows an electrical circuit for the torque control of two roll drive mechanism and FIG. 4 shows a cross section through the apparatus of FIG. 1.

In order to obtain the necessary driven torque at the guide rolls 2, load cells $M_1$ and $M_2$ are provided which are arranged at the first and last guide rolls of the installation. These electrical units measure the tensile forces $F_N$ of the length of material at the associated guide rolls 2 and transmit the forces according to FIG. 3 to a differential amplifier which converts these values to a control signal. Depending on the arithmetic sign of the resultant signal utilized for torque control, the torque of the respective top roll drive mechanism will then be altered. An optimum setting is obtained if the two load cells $M_1$ and $M_2$ are acted upon by the same forces $F_N$.

Instead of the first guide roll (2, $M_1$), it is also possible to utilize the dancer roll 6 for adjusting the torque at the last guide roll ($M_2$), since this dancer roll predetermines the desirable required torque on account of its weight and/or on account of the longitudinal tension effected by this roll in the textile material. Thus, $M_1$ can be eliminated, and $M_3$ can cooperate with $M_2$.

Figure 4:
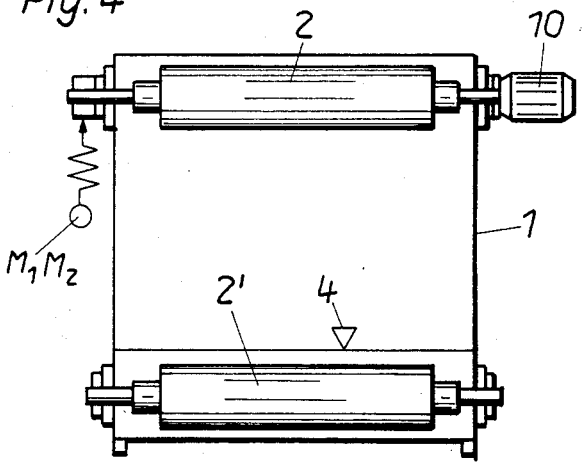

FIG. 4 once again shows the apparatus for the sake of clarity in cross-sectional view, with the upper, driven guide roll 2 and the lower, freely revolving guide roll 2'. The electric motor 10 takes care of driving the top guide roll 2, and the load cells $M_1$ and $M_2$ (or $M_3$), respectively, serve for the longitudinal tension of the length of material actually effective at this guide roll; these load cells are associated on the other long side of the apparatus with the respective shaft.

The torque does not change the RPM of the driven guide rolls 2. The guide rolls 2 are driven at a predetermined basic speed which depends upon a delivery speed of the goods controlled by the pressure rolls 5, 9. If additional positive or negative forces impact the textile material 3, due to roller friction of the guide or idler rolls 2, 2' by entrained water or by variation or changes in length of the material, which forces load the material in a longitudinal direction, that is, increase the longitudinal tension, a greater or lesser drive force is exerted on the material by the roll drive mechanisms 10, which relieves these additional forces; however, this does not increase the basic or predetermined set delivery speed of the material.

What is claimed is:

1. An apparatus for the continuous treatment of endless textile material, which comprises a housing, several guide rolls rotatably mounted in the housing; said guide rolls being arranged in two rows in series; a tension control means, including a dancer roll, a pair of pressure rollers for conveying the textile material which is connected before and/or after the guide rolls and which has a peripheral speed controlled by said tension control means; load cells; and a differential amplifier; at least two of the rolls having drive means that is electrically connected to a load cell, the measured values of the load cells, in combination, are compared in the differential amplifier and converted therein into a positive or negative control signal; said amplifier transmitting the control signal to a drive means of one of said guide rolls to correct the actual torque of the drive means.

2. An apparatus according to claim 1, wherein the first and last driven guide rolls of said treatment apparatus are each provided with one of said load cells.

3. An apparatus according to claim 2, wherein the desired torque for driving the guide rolls is determined by the active weight of the dancer roll.

4. An apparatus according to claim 1, wherein the dancer roll and the last driven guide roll of the treatment apparatus are each equipped with one of said load cells.

5. An apparatus according to claim 4, wherein the desired torque for driving the guide rolls is determined by the active weight of the dancer roll.

6. An apparatus according to claim 1, wherein the desired torque for driving the guide rolls is determined by the active weight of the dancer roll.

* * * * *